United States Patent [19]

Seidel

[11] Patent Number: 4,836,803

[45] Date of Patent: Jun. 6, 1989

[54] WIRE HOLDING DEVICE IN AN ELECTRICAL CONNECTOR

[75] Inventor: Udo Seidel, Haanbalken, Fed. Rep. of Germany

[73] Assignee: Minnesota Mining and Manufacturing Company, St. Paul, Minn.

[21] Appl. No.: 240,442

[22] Filed: Sep. 2, 1988

Related U.S. Application Data

[63] Continuation of Ser. No. 68,252, Jun. 30, 1987, abandoned.

[30] Foreign Application Priority Data

Jul. 2, 1986 [DE] Fed. Rep. of Germany ..... 3622164

[51] Int. Cl.[4] ..... H01R 9/00

[52] U.S. Cl. ..... 439/447; 439/719

[58] Field of Search ..... 439/399, 445–447, 439/719

[56] References Cited

U.S. PATENT DOCUMENTS

| | | | |
|---|---|---|---|
| 3,713,214 | 1/1973 | Enright et al. | 29/628 |
| 3,718,888 | 2/1973 | Pasternak | 439/399 |
| 3,960,431 | 6/1976 | MacKenzie et al. | 439/399 |
| 4,059,331 | 11/1977 | Sedlacek | 439/719 |
| 4,178,055 | 12/1979 | Fleischhacker et al. | 339/98 |

FOREIGN PATENT DOCUMENTS

| | | |
|---|---|---|
| 2877235 | 7/1977 | Fed. Rep. of Germany . |
| 3042309 | 7/1982 | Fed. Rep. of Germany . |
| 3207891 | 9/1983 | Fed. Rep. of Germany . |
| 3215015 | 11/1983 | Fed. Rep. of Germany . |
| 3405094 | 8/1985 | Fed. Rep. of Germany . |

*Primary Examiner*—Joseph H. McGlynn

*Attorney, Agent, or Firm*—Donald M. Sell; Walter N. Kirn; John C. Barnes

[57] ABSTRACT

A wire holding device for locating wires in an electrical connector, comprising at least one passageway into which a connection wire to be held can be moved essentially normally of its length through an outwardly enlarging entrance slot toward a closed end of the passageway. A first barb adapted to be resiliently urged aside by a wire upon the introduction thereof extends from a sidewall of the passageway adjacent the entrance slot. A second barb extends from the sidewall opposite the first barb and is adapted to be resiliently urged aside by the wire upon the introduction thereof, the free end of the second barb, together with the closed end of the passageway partitioning off a partial passageway.

13 Claims, 1 Drawing Sheet

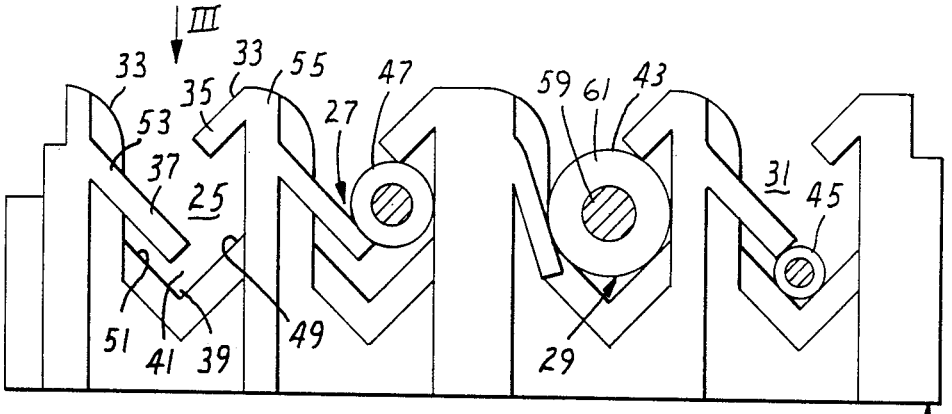
FIG. 2
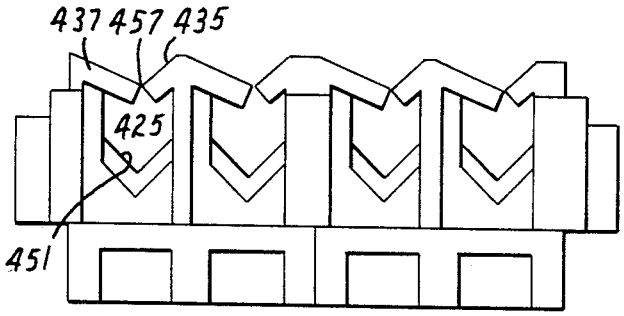
FIG. 4
FIG. 3
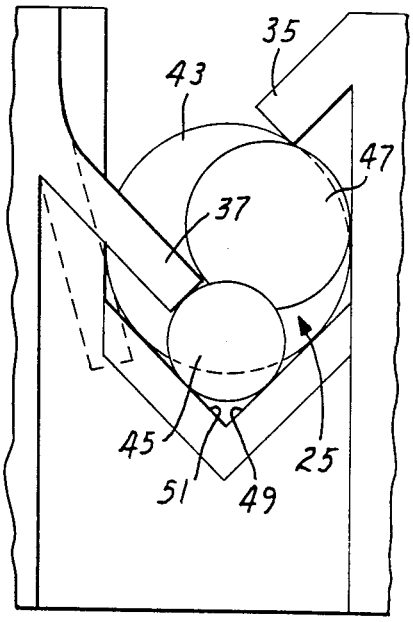
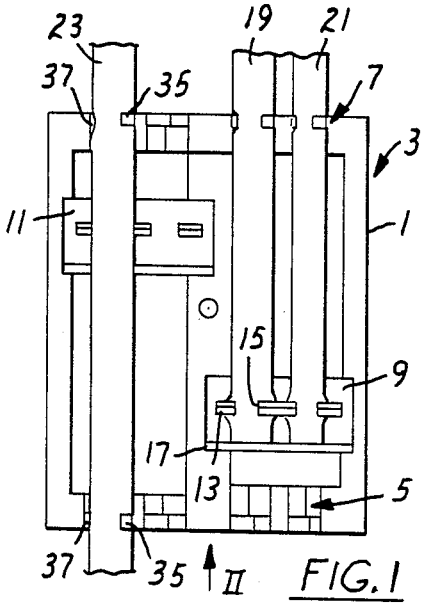
FIG. 1

WIRE HOLDING DEVICE IN AN ELECTRICAL CONNECTOR

This is a continuation of application Ser. No. 068,252 filed June 30, 1987, now abandoned.

FIELD OF THE INVENTION

The invention relates to a wire holding device for holding electrical wires in predetermined positions in an electrical connector to facilitate the making of electrical connection to the wires.

BACKGROUND OF THE INVENTION

Connectors used in the telecommunication field, for instance those used to connect multi-core telephone cables, must be as small as possible. They are normally provided with insulation displacement contact elements which are simultaneously connected to multiple wires in a connector by the operation of a tool. In doing so, the wires in the connector must all be arranged in desired positions and held in these positions until the connection is effected.

Prior wire holding devices in electrical connectors are suitable only for connection to wires within a relatively narrow range of diameters, corresponding to the dimensions of a passageway. In order that with a given design, wires of considerably smaller diameter can also be better held, the connector of U.S. Pat. No. 4,178,055 provides a second, narrower entrance slot which is arranged in the entrance slot and in the passageway is a diaphragm which will be destroyed upon the introduction of a wire of normal diameter. Thus, the introduction of a connection wire of normal thickness is obstructed, and moreover, there is the danger that upon the destroying of the diaphragm, the insulation of the wire will be damaged in an area where it should remain intact.

U.S. Pat. No. 3,713,214 discloses another electrical connector with a wire holding device wherein the wires are clamped between convolutions of a coil spring, with a plurality of coil springs being provided to be made selectively effective in order that wires of different thicknesses can be held. That solution is structurally very expensive and hardly suitable for practical purposes because of the large space required.

SUMMARY OF THE INVENTION

The holding device of the present invention is for holding electrical wires in an electrical connector and comprises at least one passageway into which a wire to be held can be moved essentially normally of its length through an outwardly enlarging entrance slot toward a closed end of the passageway. A first barb which can be resiliently urged aside by the wire upon the introduction thereof extends from a sidewall of the passageway adjacent the entrance slot. A second barb which can be resiliently urged aside by the wire upon insertion thereof extends from the sidewall of the passageway that is opposite to the first barb, the free end of the second barb together with the closed end of the passageway positioning off a partial passageway.

A thick wire is retained by the first barb, with the second barb pressing the wire to the interior surface of the passageway. A wire of considerably smaller thickness can be snappingly held between the two barbs. A wire of a still considerably smaller thickness can be held solely by the second barb in the partial passageway.

THE DRAWING

In the drawing:

FIG. 1 is a diagrammatic plan view of the lower part of an electrical connector for connecting two pairs of electrical wires, with the left-hand half of FIG. 1 showing one of the wires of a pair to be interconnected as being inserted but not yet electrically connected, whereas the right-hand half of FIG. 1 illustrates a pair of wires which are already electrically connected;

FIG. 2 is an end elevation view taken in the direction of the arrow II of FIG. 1, but illustrates other wires than FIG. 1;

FIG. 3 is a partial end elevation view corresponding to the area III of FIG. 2, illustrating the holding of wires of different diameters; and FIG. 4 is an end elevation view similar to that of FIG. 2 of a second embodiment of a wire holding device in accordance with the present invention.

DESCRIPTION OF THE PREFERRED EMBODIMENT

FIG. 1 illustrates a lower part 1 of an electrical connector 3 which comprises a wire holding device 5, 7 at each of two opposite ends. Furthermore, the lower part 1 contains two insulation displacement contact elements 9, 11 in each of which a pair of wires extending through the holding device can be interconnected. The interconnection is effected in a known manner, by a non-illustrated upper part being put onto the lower part 1, and a pressing force being exerted on the areas disposed above the contact elements 9, 11; thereby, the wires will be advanced into slots in the contact elements (for example between legs 13 and 15) and have their insulation severed and thereby they will be electrically connected to the contact element and through the contact element to each other. The illustrated contact elements 9, 11 also include a blade 17, which upon electrical connection of a pair of wires will cut off the projecting portions of the connected wires so that the overall condition shown on the right hand of FIG. 1 will result in which two wires 19, 21 are electrically interconnected. In the left-hand half of FIG. 1, a single wire 23 is illustrated which has been already inserted into the holding devices 5 and 7 but is not yet electrically connected.

FIGS. 2 and 3 illustrate the structure of the holding device 5 in end views. The wire holding device 5 illustrated contains four passageways 25, 27, 29, 31 arranged side-by-side. In FIG. 2, wires of different diameters are illustrated as being held in the passageways 27, 29, and 31. In the following, only the structure provided in the first passageway 25 will be described in detail since the structure in all of the passageways is the same. The passageway 25 is accessible from the exterior through an entrance slot 33 which enlarges outwardly to facilitate a convenient introduction of a wire in a direction transverse of its length toward a closed end 39 of the passageway. A first barb 35 extends from a sidewall of the passageway adjacent the entrance slot 33, which can be resiliently urged aside by a wire upon the insertion thereof. A second barb 37 extends from the opposite sidewall of the passageway 25, which can be resiliently urged aside by the wire upon the insertion thereof. There is only one barb provided on each sidewall in a non-symmetrical relationship. The second barb 37 has a free end which, together with the closed end 39 of the passageway 25, partitions-off a partial passageway 41 so that a wire 43 of a relatively large diameter (compare passageway 29) will be resiliently contacted in the passageway by the second barb, i.e. pressed against the opposite interior wall of the passageway, while the first barb 35 secures the connection wire against outward movement. A wire 45 of a relatively small diameter (compare in FIG. 2 the passageway 29) can be held in the partial passageway 41 by the free end of the second barb 37, and a wire 47 of intermediate diameter (compare in FIG. 2 the passageway 27) can be held between the two barbs 35 and 37. These possibilities are diagrammatically illustrated in FIGS. 2 and 3.

In the illustrated embodiment, the closed end 39 of the passageway 25 is formed by two angularly extending wall portions 49, 51 of the passageway 25. This will make possible a proper fit of wires of different diameters. In the embodiment illustrated, the first barb 35 extends essentially parallel to the adjacent oblique wall portion 49 of the closed end 39 of the passageway 25. This will facilitate the manufacture of the holding device in one piece. In the embodiment illustrated, the second barb 37 extends essentially parallel to the opposite oblique wall portion 51 of the closed end of the passageway 25.

In the embodiment illustrated in FIGS. 2 and 3, the root 53 of the second barb 37 is closer to the closed end 39 of the passageway 25 than the root 55 of the first barb 35. Thereby, the insertion of a wire is facilitated, and the inserted wire is guided beneath the first barb 35 in the manner desired to obtain interlocking.

In the embodiment illustrated, the second barb 37 is longer than the first barb 35. Thereby, the second barb can effect a pressing function as well as a retaining function with respect to the partial passageway 41. The first barb 35 need be only as long as to be capable of retaining a wire of the largest diameter to be applied.

FIG. 4 illustrates an embodiment that is essentially the same as the embodiment of FIGS. 1, 2 and 3, but is illustrated in a pre-use condition in which the free ends of the two barbs 435, 437 are interconnected via a connection 457 which can be broken by the introduction of a wire. Due to that destroyable connection 457, the wire holding device can be manufactured more easily. Moreover, the force that is necessary to disrupt the connection 457 ensures that the respective wire is driven completely into its final position in the passageway 425. The disrupting of the connection 457 can be sensed audibly and tactilely; thereby, the operator receives an indication that the respective wire has been fully inserted into the wire holding device. Furthermore, the connection 457 provides that the two barbs 435 and 437 are not inadvertently prematurely pressed-in during the storage and upon handling of the wire holding devices. This is particularly important if the barbs, as illustrated, are unitary constituents of a structural part of plastic material and do not have an ideal resiliency.

In the embodiment illustrated in FIG. 4, and in the pre-use condition illustrated, the second barb 437 extends at an acute angle to the adjacent wall portion 451 of the closed end of the passageway 425. This is appropriate in order that after the disrupting of the connection 457, the second barb 437 can be urged into a use position similar to that shown in FIG. 2, so that it will extend approximately parallel to the wall portion 451.

As can be recognized, wires of different diameters can be smoothly inserted and securely held in the described wire holding device. With usual wires which consist of a solid conductor core and an outer insulation (compare in FIG. 2 the conductor core 59 and the insulation 61 of the connection wire 43), the insulation will not be damaged in the wire holding device. Even with the embodiment in the pre-use condition according to FIG. 4, the insulation of the inserted wires will not be damaged because the connection 457 to be disrupted extends in the longitudinal direction of the connection wire, and there is no sharp rigid edge along which the wire must be moved.

I claim:

1. A wire holding device positioned at one end of an electrical connector, said device comprising at least one passageway into which a wire to be held can be moved essentially normally of its length through an outwardly enlarging entrance slot toward a closed end of the passageway, a pair of non-symmetrical barbs for holding a said wire in said passageway consisting essentially of a first barb which can be resiliently urged aside by the wire upon the introduction thereof extending rom a sidewall of the passageway adjacent the entrance slot, and a second barb which can be resiliently urged aside by the wire upon the insertion thereof extending from the sidewall of the passageway that is opposite to the first barb, each barb having a root joining it to the respective sidewall, the free end of the second barb together with the closed end of her passageway partitioning off a partial passageway, whereby a large diameter wire will be resiliently contacted in the passageway by the second barb and restricted by the first barb against outward movement, a small diameter wire can be restricted against outward movement in the partial passageway by the free end of the second barb, and an intermediate diameter wire can be held between the two barbs and restricted against outward movement by the first barb.

2. The device according to claim 1 wherein the closed end of the passageway is formed by two wall portions of the passageway which extend at an angle to each other.

3. The device according to claim 2 wherein the first barb extends approximately parallel with the adjacent wall portion of the closed end of the passageway.

4. The device according to claim 3, wherein the second barb extends approximately parallel to the adjacent wall portion of the closed end of the passageway.

5. The device according to claim 1 wherein the root of the second barb is closer to the closed end of the passageway than the root of the first barb.

6. The device according to claim 5 wherein the second barb is longer than the first barb.

7. The device according to claim 1 wherein the barbs are unitary constituents of a structural part of plastic material.

8. The device according to claim 1 including a presue condition in which the free ends of the two barbs are interconnected via a connection which is adapted to be disrupted by the introduction of a wire.

9. The device according to claim 8 wherein in the pre-use condition, the second barb extends at an acute angle to the adjacent wall portion of the closed end of the passageway.

10. The device according to claim 1 wherein said second barb is positioned closer to the closed end of the passageway and is longer than the first barb and both barbs extend toward the closed end.

11. A wire holding device positioned at one end of an electrical connector, said device comprising at least one passageway into which a wire to be held can be moved essentially normally of its length through an outwardly enlarging entrance slot toward a closed end of the passageway, a pair of non-symmetrical barbs for holding a said wire in said passageway consisting essentially of a first barb which can be resiliently urged aside by the wire upon the introduction thereof extending from a sidewall of the passageway adjacent the entrance slot, and a second barb which can be resiliently urged aside by the wire upon the insertion thereof extending from the sidewall of the passageway that is opposite to the first barb, each barb having a root joining it to the respective sidewall the free end of the second barb together with the closed end of the passageway partitioning of the passageway adjacent said closed end, whereby a large diameter wire will be resiliently contacted by both barbs upon entry into the passageway and a smaller diameter wire will resiliently contact only one of the barbs, but upon entry into the passageway the wire will be restricted against outward movement by the barbs.

12. The device according to claim 11 wherein said first barb and said second barb have their roots positioned in opposed relationship on opposite sidewalls of the passageway.

13. The device according to claim 11 including a pre-use condition in which the free ends of the two barbs are interconnected via a connection which is adapted to be disrupted by the introduction of a wire.

* * * * *